United States Patent [19]

Davidson

[11] Patent Number: 4,604,515

[45] Date of Patent: Aug. 5, 1986

[54] TANKLESS ELECTRIC WATER HEATER WITH STAGED HEATING ELEMENT ENERGIZATION

[75] Inventor: Mel Davidson, Houston, Tex.

[73] Assignee: CMR Enterprises, Inc., Houston, Tex.

[21] Appl. No.: 661,372

[22] Filed: Oct. 16, 1984

[51] Int. Cl.[4] ..... H05B 1/02; H05B 3/82; F24H 1/10

[52] U.S. Cl. ..... 219/298; 219/306; 219/314; 219/321; 219/331; 219/486

[58] Field of Search ..... 219/296, 298, 299, 306, 219/307, 308, 305, 312, 314, 316, 328, 330, 331, 486, 487

[56] References Cited

U.S. PATENT DOCUMENTS

| | | | |
|---|---|---|---|
| Re. 16,715 | 8/1927 | Nesmith . | |
| 1,224,117 | 4/1917 | Nesmith . | |
| 1,318,237 | 10/1919 | Sordi . | |
| 1,731,058 | 10/1929 | Pierson . | |
| 2,140,389 | 12/1938 | Lum . | |
| 2,184,308 | 12/1939 | Leach . | |
| 2,237,808 | 4/1941 | Berg | 219/321 X |
| 2,553,212 | 5/1951 | Rouis et al. . | |
| 2,710,908 | 6/1955 | Doniak . | |
| 2,825,791 | 3/1958 | Jackson | 219/314 X |
| 2,958,755 | 11/1960 | Miller . | |
| 3,952,182 | 4/1976 | Flanders | 219/331 X |
| 4,337,388 | 6/1982 | July | 219/308 X |
| 4,395,618 | 7/1983 | Cunningham | 219/320 |
| 4,459,465 | 7/1984 | Knight | 219/306 X |

*Primary Examiner*—A. Bartis

*Attorney, Agent, or Firm*—Pravel, Gambrell, Hewitt & Kimball

[57] ABSTRACT

A tankless electric water heater includes a housing provided with a plurality of separate serially connected heating chambers defining a water flow path from a cold water inlet port to a heated water outlet port. Each chamber is provided with a separate electric immersion heating element and a separate temperature sensor for producing a signal indicative of the water temperature in that chamber. The heating element of each chamber is independently controlled by a control system responsive to signals from each of the temperature sensors and the signal produced by an water outlet temperature selector so that the heating element in a chamber is energized only if the sensed water temperature in that chamber is less than the desired outlet water temperature. The number of heating elements energized is proportional to the flow rate, necessary water temperature and heating capability of the heating elements, thus eliminating the problem of overheating at low flow rates.

9 Claims, 6 Drawing Figures

TANKLESS ELECTRIC WATER HEATER WITH STAGED HEATING ELEMENT ENERGIZATION

BACKGROUND OF THE INVENTION

The present invention relates to water heaters and, more particularly, to those which provide hot water continuously without the need for a storage tank.

Water heaters are well known and generally include a storage tank, a thermostat, a heat source and inlet and outlet ports. The water in the tank is heated until it reaches a preset temperature controlled by the thermostat.

Because the water is heated in a relatively large tank, the heating rate of these conventional storage heaters is relatively low. Water is not heated at the same rate it is used. Instead, heat is applied to water in the tank so that a relatively long period of time is required to heat the water to the desired temperature.

The storage tank provides a reserve of heated water, which is used to supply short term needs. If more hot water is used than that in the tank, the outlet water temperature drops dramatically because of the low heating rate of the unit. This requires a close approximation of the amount of hot water that has to be used in one interval. When the water flow is stopped, the heater once again heats water in the storage tank to the desired temperature and therefore insures a sufficient hot water supply for the next use.

This arrangement requires the storage tank to be located in an environment with an ambient temperature lower than that of the water in the tank. The tank tends to lose heat to the ambient air, thus lowering the water temperature and requiring the heating element to reheat the water. This energy is lost to the environment and provides no tangible benefits.

One solution to this problem has been to better insulate the storage water heaters. This moderately reduced the amount of heat lost to the environment, but did not eliminate all heat loss and also took up additional space.

A second solution has been various configurations of tankless water heaters. These units did not have a storage tank, but heated the water as it flowed through the device. This arrangement eliminated most of the storage-tank heat losses. The space problem would also be solved because the need to store a large volume of water was removed. An unlimited supply of hot water was also now available, because it could continuously flow through the tankless system.

However, problems were present in these units. For a given energy input, temperature rise was proportional to water flow rate. Most units were small capacity units, having limited flow rates or temperature rises. The larger units had satisfactory maximum flow rates and maximum temperature rises, but also required larger minimum flow rates before they became operational. If they were turned on at lower flow rates, the water would overheat by the time the water reached the outlet port. This aspect limited their use to situations having relatively high minimum flow rates.

SUMMARY OF THE INVENTION

The water heater of the present invention retains the positive features of the prior tankless water heaters and eliminates the low flow rate overheating problem of the tankless heaters as well as the inefficiency and high energy loss of conventional storage tank heaters.

In the present invention, called a water heater, the heating area contains a plurality of heating elements arranged in series. The water enters the heater from an inlet port. The water then flows over a series of heating elements that are sequentially arranged and leaves the device by an outlet port. The heating elements may be contained in separate, individual chambers or in a single continued chamber. If the temperature of water flowing out of the heater outlet is below the desired temperature set on the temperature control, the proper number of heating elements are activated to raise the outlet water temperature to the desired level. The number of heating elements that are activated is proportional to the flow rate, necessary temperature rise and heating capabilities of the elements. Therefore, with a lower flow rate or lesser temperature rise, fewer heating means are operating.

One possible way to do this is to stage the heating elements by locating them in separate chambers, with a temperature sensor for turning each heating element on or off depending on the water temperature in its chamber.

The unit includes a sufficient number of heating elements to provide the total heating capacity needed at the maximum desired temperature rise and maximum desired flow rate, so that a continuous flow of hot water at the desired temperature can be maintained.

Low flow rates are possible in the present invention without overheating the water, because of the staged design. The unit is compact because no tank is needed to store a reserve heated water supply. Only minor heat losses to the environment exist, coming only from the small amount of water resident in the device itself.

DESCRIPTION OF THE PREFERRED EMBODIMENT

Figure 1:
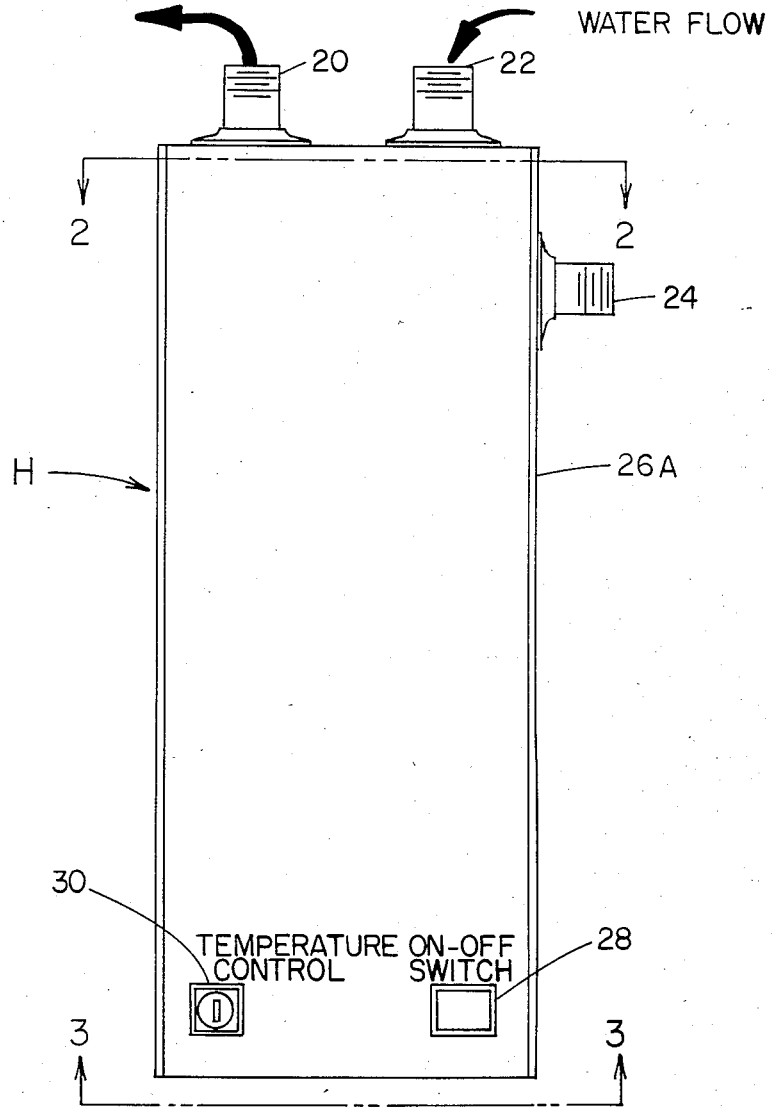
FIG. 1 is a front view of the water heater of the present invention.

Referring now to FIG. 1, the letter H is used to designate generally a water heater according to the present invention. The heater H contains a heater inlet port 22, a heater outlet port 20, a relief port 24 and an outer housing 26 having a door 26A and a bottom plate with hole 26B. Mounted in the door 26A are an on-off switch 28 and a temperature control 30.

Figure 2:
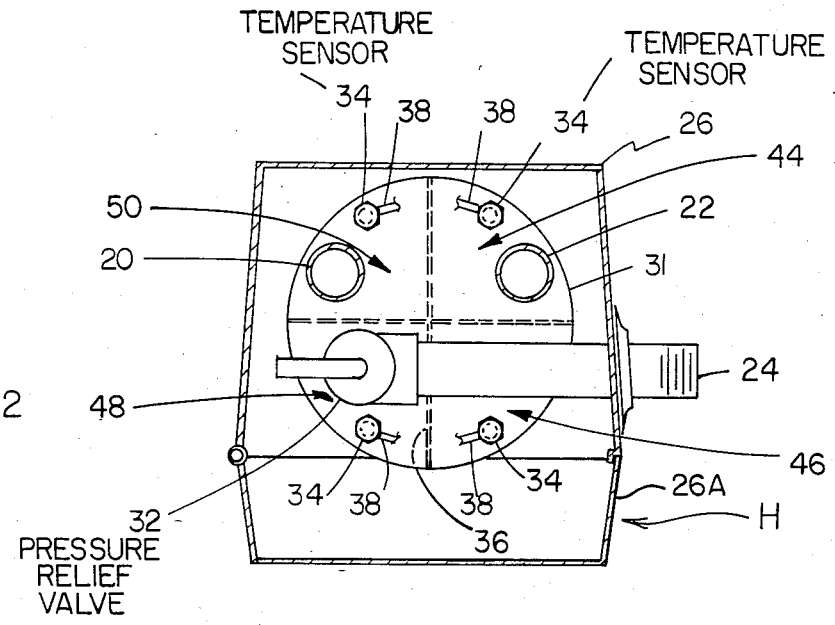
FIG. 2 is a plan view in partial cross-section taken along line 2—2 as shown in in FIG. 1 of the water heater of the present invention.

As shown in FIG. 2, the heater inlet port 22 and the heater outlet port 20 are connected to an inner housing 31. The connections can be formed of standard three-quarter inch piping. The inner housing 31 is divided into four independent chambers by heat exchanger internal walls 36. The inner housing 31 is five inches in diameter and has a length of approximately sixteen inches. These dimensions can vary depending on the desired flow rate, temperature rise, number of chambers and heating capability of heating elements. The relief port 24 is connected to the inner housing 31 by means of a relief valve 32. The connections can be formed by using standard three-quarter inch piping. The relief valve 32 is of a type well known in the industry. Four temperature sensors 34 and their associated temperature sensor leads 38 are located at the top of inner housing 31, each sensor 34 projecting into one of the chambers in the inner housing 31.

Figure 3:
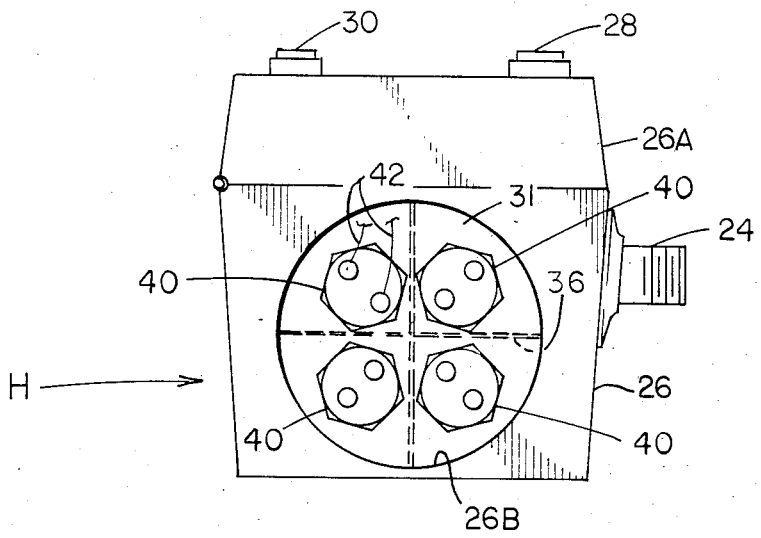
FIG. 3 is a bottom view taken along line 3—3 as shown in FIG. 1 of the water heater of the present invention.

FIG. 3 shows a bottom view of the water heater H. From this view the heating elements 40 can be seen mounted in the inner housing 31. Each heating element 40 has two heating element leads 42 which are connected to the electrical circuitry as discussed below. The preferred embodiment uses electrical resistive heating elements as the heating means, although other ways of providing the heat input, such as, for example, natural or bottled gas heating elements, are possible.

Figure 4:
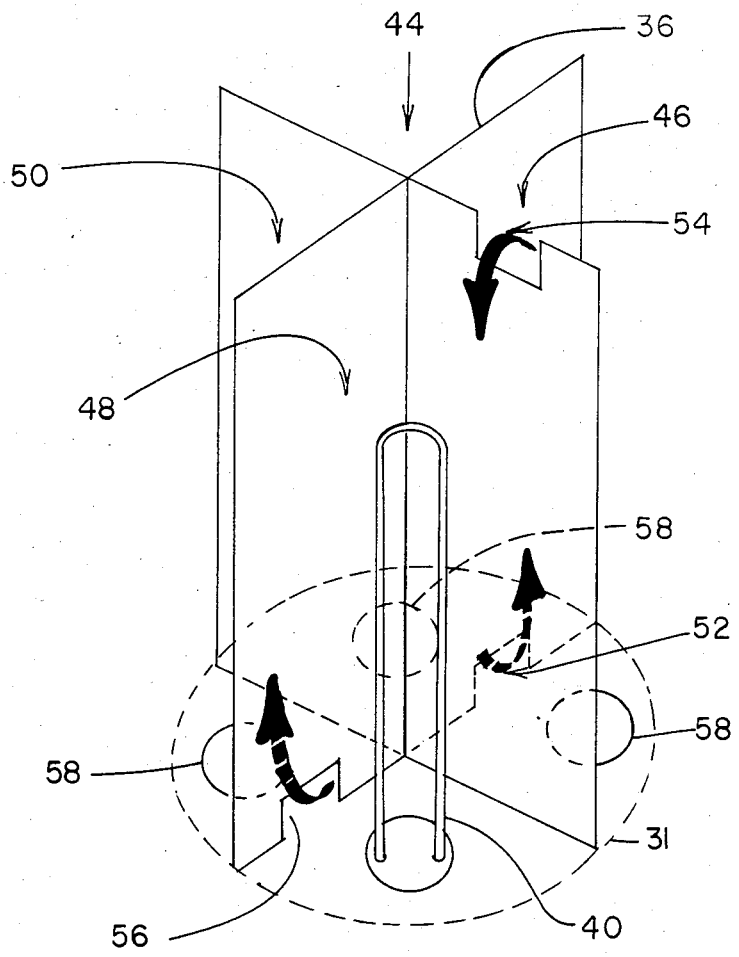
FIG. 4 is an isometric view of the internal chambering of a preferred embodiment of the present invention.

FIG. 4 illustrates the chambers formed by the inner walls 36 and the flow path of the water through the water heater H. The example shown is a four chambered system, although other chamber configurations could be used. Each chamber of FIG. 4 is of an equal size and contains a heating element 40. In FIG. 4, a heating element 40 is shown mounted in one chamber, while three other heating element locations are indicated by lines 58.

Cold water enters a first chamber 44 from the top. The water then flows down the chamber, passing by the heating element 40, located in that chamber. After being heated by the first heating element 40, the water flows through chamber port 52 into a second chamber 46. The chamber port 52 measures approximately five-eighths of an inch by seven-eighths of an inch. These dimensions can be varied depending on the particular flow rate and temperature rise desired in the water heater. The circuitry for controlling of the heating elements 40 is discussed in greater detail below.

The water is then heated, if necessary, by the heating element 40 located in second chamber 46. The water then flows upwardly through the second chamber 46 and a chamber port 54 into third chamber 48. The water then flows downwardly through a third chamber 48, past the heating element 40, and through a chamber port 56 into the fourth chamber 50. Chamber ports 54 and 56 are the same size as chamber port 52. The water then flows upwardly past the heating element 40, which is located in heater element location 58, to the top of fourth chamber 50. The hot water heater outlet 22 (FIG. 1) is located at the top of chamber 50.

Figure 5:
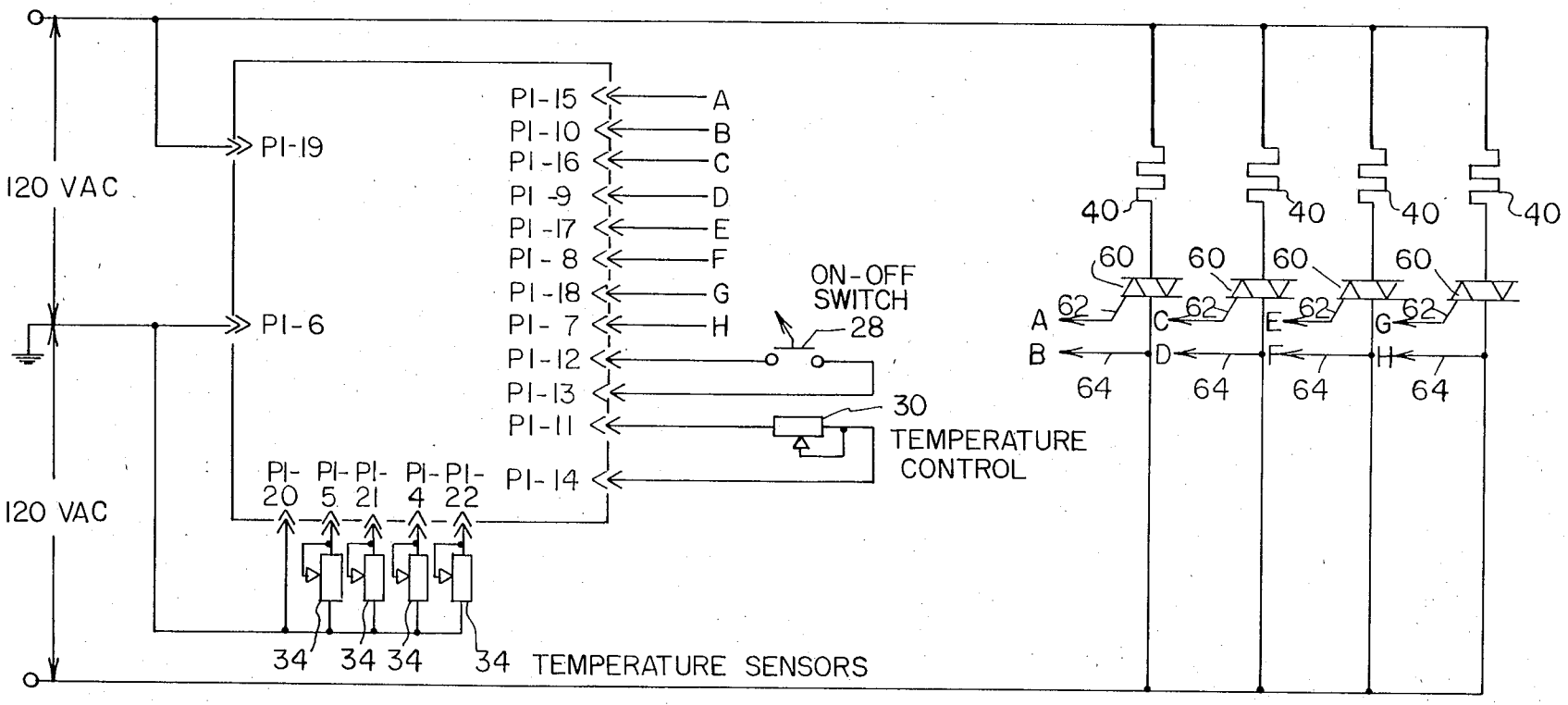
FIG. 5 is an electrical schematic diagram of the external circuitry of a preferred embodiment.
Figure 6:
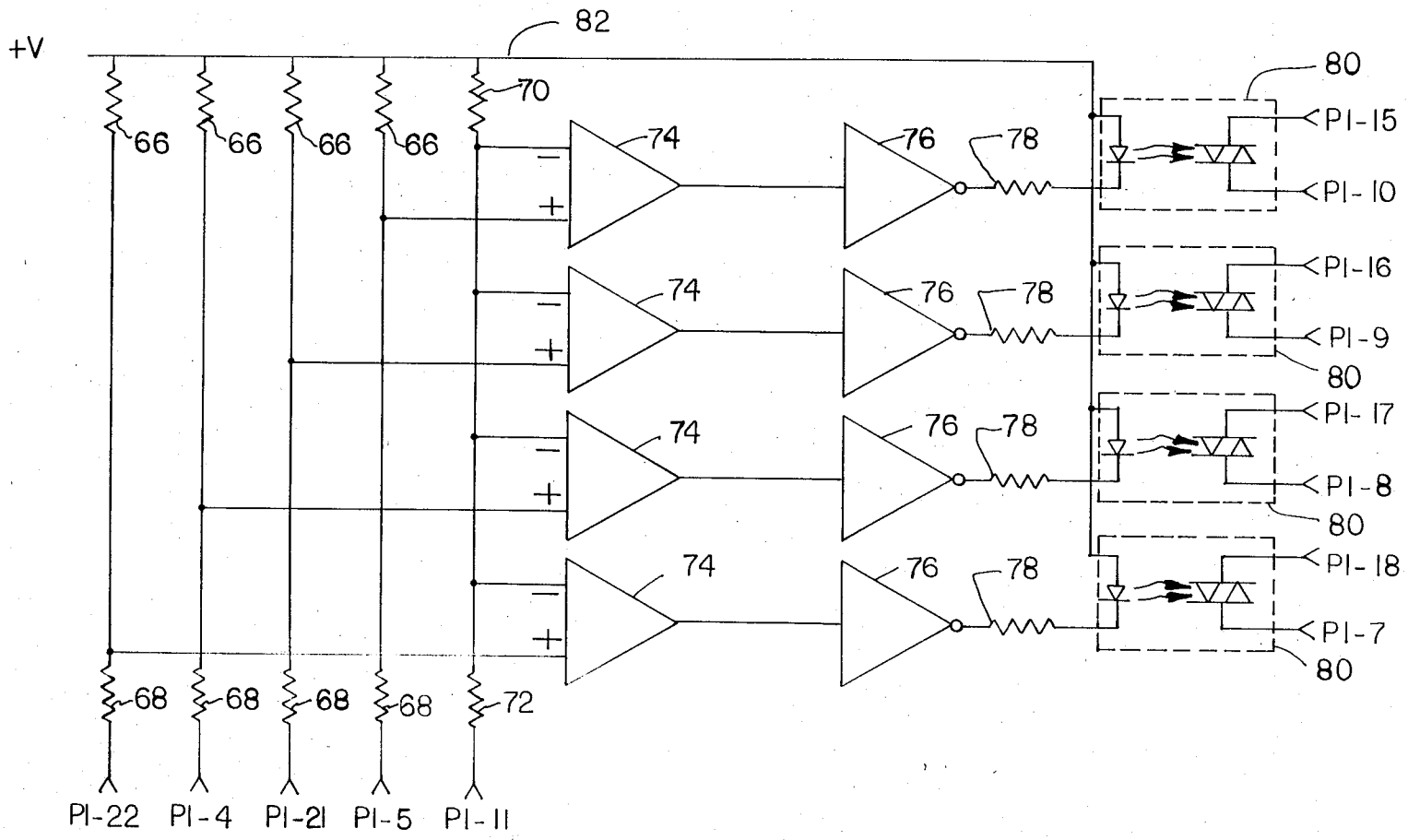
FIG. 6 is an electrical schematic diagram of the control circuitry of the preferred embodiment.

FIGS. 5 and 6 schematically show the electrical parts of the preferred embodiment. A power supply of conventional design, which to supplies a DC voltage to the control circuitry, is not shown because it is of standard design and well known in the art.

An on-off switch 28 controls the power to the control circuitry. In the off position, the control circuitry is not powered and the heater will not function. In the on position the control circuitry is energized and active. The temperature control 30 is a potentiometer, the resistance of which can be varied to set a reference level that corresponds to a desired temperature control setting. This is done by means of resistors 70, 72 and a temperature control 30. The resistors 70, 72 form a divider network that produces a desired temperature reference level which is connected to the inverting input of operational amplifiers 74. From this point on, the circuitry includes four identical circuits which operate independent of each other. Each such circuit operates to control one of the heating elements 40. Only one circuit needs to be described because the other three are designed the same.

A temperature sensor 34 is located in each chamber in the inner housing 31. The temperature sensor 34 is a device which appears electrically as a variable resistor. The temperature sensor is connected to resistors 66, 68 to provide a voltage divider network. The point between resistors 66, 68 is connected to the non-inverting input of an operational amplifier 74. The actual resistance values of the resistors 66, 68, 70, 72, the temperature control 30, and the temperature sensor 34 are interrelated. The values can vary over a wide range. The ratio of the value of the resistor 66 to the sum of the value of the resistors 66, 68 and the temperature sensor 34 should equal the ratio of the value of the resistor 70 to the sum of the values of the resistors 70, 72 and the temperature control 30 when the sensed water temperature is at the same temperature as indicated by the temperature control 30, assuming that the dividers are connected to equal value voltage levels. In the preferred embodiment, the resistors 66, 70 have a nominal resistance of 1000 ohms, resistor 68–10 ohms and resistor 72–47 ohms. Temperature control 30 has a maximum resistance of about 200 ohms. Temperature sensor 34 has a resistance between about 160 ohms and 20 ohms with a resistance of 20 ohms at 212° F. As the temperature of the water in contact with the temperature sensor 34 increases, the resistance of the temperature sensor 34 decreases, causing the voltage at the non-inverting input of the operational amplifier 74 to lower.

An operational amplifier 74 is employed in a comparator configuration. As the voltage on the non-inverting input exceeds the voltage on the inverting input, the output of the operational amplifier 74 goes to a high or one level. As the voltage on the inverting input increases to a level greater than the voltage on the non-inverting input, the output of the operational amplifier 74 goes low or becomes a zero. When the temperature sensor divider network and temperature control divider network are connected as indicated, which occurs when the actual water temperature is less than the desired water temperature, the output of the operational amplifier 74 goes high. When the water is hotter than desired, the output of operational amplifier 74 goes low. This output level of the operational amplifier 74 is then used to control the on or off condition of the heating element 40.

The output of the operational amplifier 74 is connected to an inverter driver 76 to obtain the proper signal level for enabling the remaining circuitry to activate the heating element 40. The high level at the input of the inverter driver 76 produces a low level at the output of the inverter driver 76. This low level then allows current to flow from the positive supply voltage through a light emitting diode contained in an optically isolated triac 80, to the bias resistor 78, to the output of the inverter driver 76. The bias resistor 78 is sized to create the necessary current in the diode in the optically isolated triac 80 to activate the triac. The bias resistor 78 value depends on supply voltage, the output voltage of the diode voltage drop inverter driver 76 and necessary turn-on current.

The use of the optically isolated triac 80 provides both the noise isolation and the voltage isolation necessary because of the noisier and higher voltage environment of the actual heating element 40. The triac in the optically isolated triac 80 has one main terminal connected to the gate of a higher powered heater triac 60 and the second main terminal connected to a leg of the AC power line. The triac in optically isolated triac 80 is a low power device, so a higher power capability device is needed to actually control the heating element 40. The heating element 40 is a 240 volt AC, 4500 watt element as is commonly available. Use of this size heating element allows the 18 kilowatt unit to create a 50° F. temperature rise at a 150 gallon per hour flow rate.

When the optically isolated triac 80 is activated the heater triac gate 62 is in turn activated, which activates the heater triac 60. The heater triac 60 has one main terminal connected to the heating element 40 and the second main terminal connected to the same leg of the AC power line as the second main terminal of the optically isolated triac 80. The heating element 40 is connected to the other leg of the AC power line and to the first main terminal of heating triac 60. When the heater triac 60 is turned on it essentially forms a low resistance device, which operates to allow current to flow between the two AC voltage lines through the heater element 40.

Once either triac 80 or triac 60 has begun conducting for a given half cycle of the AC waveform, it will continue conducting for the rest of that half cycle. When the water temperature as indicated by the temperature sensor 34 increases the resistance of temperature sensor 34 decreases changes the output of the operational amplifier 74 to a low level, therefore creating a high level at the output of the inverter driver 76 and shutting off optically isolated triac 80. The heater triac and the optically isolated triac 80 continue conducting for the remaining half cycle and do not conduct for the remaining AC cycles until they are again activated.

When the temperature of the water in contact with the temperature sensor 34 decreases, the situation reverses and the heating element 40 is activated. The heating element 40 is energized when the temperature sensor 34 indicates that the water is below the setting of the temperature control 30. There is a delay only if the AC voltage is not sufficient to activate the gates of the triac 60 and the triac 80. This will not be an appreciable delay in the preferred embodiment. The use of triacs as described allows the control circuit to adjust the heating rate at a maximum of 120 changes per second. The temperature of the water is raised until the water reaches the desired temperature as indicated by the reference level appearing at the inverting input of the operational amplifier 74. The heating element 40 will then be shut off.

The use of four independently operable heater control circuits inherently produces the staging effect for heating water in the present invention. The water flowing into the first chamber 44 is the coldest water entering the water heater H. Therefore, the heating element 40 in the first chamber 44 is the most likely to be activated. If the water flow rate is sufficiently low, heat supplied by only the first element is sufficient to heat the water to the desired temperature as set on the temperature control 30. In this case, as the water passes through chambers 46, 48 and 50 with their associated temperature sensors 34 and heating elements 40, the heating elements 40 are not activated because the temperature of the water is already sufficient to exceed the desired amount. If the flow rate is such that the first heating element 40 could not supply sufficient heat to the water, the second heating element 40 turns on and begins providing heat to the water. If this element in conjunction with the first element are sufficient to heat the water to desired level, the third and fourth heating elements 40 are activated and the water flows through the heater as before. If the second element does not provide sufficient energy to heat the water to the desired level, the third element is activated and so on.

Therefore, the independent control of the heating element in each chamber leads readily to the staging required to resolve the conflict of the low flow rate heating condition and the higher flow rate and temperature rise conditions required for full maximum operation and continuous flow. The staging of heating elements as required by the present invention could be accomplished using different control circuitry and techniques that are well known in the industry.

The foregoing disclosure and description of the invention are illustrative and explanatory thereof, and various changes in the size, shape and materials, as well as in the details of the illustrated construction, including improvements, may be made without departing from the spirit of the invention and are contemplated as following within the scope of the appended claims.

I claim:

1. A water heater comprising:

(a) a housing, including heater inlet and outlet ports adapted to receive and discharge, respectively, water to be heated and circulated along a flow path through the housing;

(b) the housing including a plurality of heating chambers, serially connected along the flow path;

(c) each chamber including an inlet and outlet;

(d) a separate heating means and a separate temperature sensing means for each chamber, the temperature sensing means producing a signal indicative of the water temperature in the chamber;

(e) an outlet temperature selecting means for producing a signal indicative of a desired temperature for water flowing through the outlet port; and (f) control means connected to each heating means and responsive to the signals produced by each of the temperature sensing means and to the signal produced by the outlet temperature selectivng means for individually controlling the energization of each of said separate heating means to maintain the water flowing through the outlet port at a desired temperature by energizing the heating means in each chamber only if the temperature of the water in that chamber as sensed by the temperature sensing means in that chamber is below the desired outlet temperature as selected by said outlet temperature selecting means.

2. The water heater of claim 1, wherein the chambers are formed as separate compartments in the housing.

3. The water heater of claim 2, wherein the housing is cylindrical in shape and the chambers are formed by divider means extending longitudinally inside the housing.

4. The water heater of claim 3, wherein the outlet for the first chamber, the inlet for the last chamber and the inlet and outlet for each of the remaining chambers are located in the divider means adjacent to the ends of the housing.

5. The water heater of claim 4, wherein the heating means for each chamber is mounted on one end of the housing and extends through the length of the chamber.

6. The water heater of claim 5, wherein the housing includes four chambers, the inlet port communicating with the first chamber and being located at the end of the housing opposite the end mounting the heating means for the first chamber, the inlets and outlets for the other chambers being located so that water flows in opposite directions through succeeding chambers, the outlet port communicating with the fourth chamber and being located on the same end as the inlet port.

7. The water heater of claim 1, wherein the heating means includes a fixed value, electrically resistive heating element.

8. The water heater of claim 1, wherein the temperature sensing means is an electrical temperature sensor.

9. The water heater of claim 1, wherein the temperature selecting means includes a variable resistor for producing a signal indicative of the desired outlet port water temperature.

* * * * *